US006704703B2

(12) United States Patent
Ferhaoul et al.

(10) Patent No.: US 6,704,703 B2
(45) Date of Patent: Mar. 9, 2004

(54) RECURSIVELY EXCITED LINEAR PREDICTION SPEECH CODER

(75) Inventors: Mohand Ferhaoul, Rouiba (DZ); Jean-Francois Rasaminjanahary, Fandriana (MG); Stefaan Van Gerven, Heverlee (BE); Abderrahman Essebbar, CYM Rabat (MA)

(73) Assignee: ScanSoft, Inc., Peabody, MA (US)

( * ) Notice: Subject to any disclaimer, the term of this patent is extended or adjusted under 35 U.S.C. 154(b) by 255 days.

(21) Appl. No.: 09/775,458

(22) Filed: Feb. 2, 2001

(65) Prior Publication Data

US 2001/0044717 A1 Nov. 22, 2001

Related U.S. Application Data

(60) Provisional application No. 60/180,272, filed on Feb. 4, 2000.

(51) Int. Cl.[7] ..... G10L 19/12
(52) U.S. Cl. ..... 704/223; 704/221
(58) Field of Search ..... 704/219, 220, 704/221, 222, 223; 706/22; 341/106

(56) References Cited

U.S. PATENT DOCUMENTS

| | | | | | |
|---|---|---|---|---|---|
| 5,408,234 | A | * | 4/1995 | Chu | 341/106 |
| 5,699,485 | A | * | 12/1997 | Shoham | 704/220 |
| 5,706,402 | A | * | 1/1998 | Bell | 706/22 |
| 5,717,824 | A | * | 2/1998 | Chhatwal | 704/220 |
| 6,014,618 | A | * | 1/2000 | Patel et al. | 704/220 |
| 6,073,092 | A | * | 6/2000 | Kwon | 704/219 |
| 6,243,674 | B1 | * | 6/2001 | Yu | 704/221 |

FOREIGN PATENT DOCUMENTS

GB WO 95/16260 * 6/1995 ..... G10L/7/00

OTHER PUBLICATIONS

McElroy et al ("Wideband Speech Coding Using Multiple Codebooks And Glottal Pulses", International Fonference on Acoustics, Speech and Signal Processing, pp. 253–256 vol. 1, May 1995).*

Jones (Good Weights And Hyperbolic Kernels For Neural Networks, Projection Pursuit, And Pattern Classification: Fourier Strategies For Extracting Information From High–Dimensional Data, IEEE Transactions on Information Theory, Mar. 1994.*

* cited by examiner

*Primary Examiner*—Daniel Nolan
(74) *Attorney, Agent, or Firm*—Bromberg & Sunstein LLP

(57) ABSTRACT

The excitation in a CELP-like speech coder is recursively calculated. For a given bitrate and a given complexity, the recursive approach described lowers the complexity with minimum impact on speech quality. The excitation signal is a sum of at least three vector terms, each vector term being a product of a codebook vector $z_k$ and an associated gain term $g_k$. A first vector term $g_0z_0$ is determined that is representative of a target excitation vector x. Each remaining vector term is recursively determined as a vector term $g_kz_k$ representative of the difference between the target excitation vector x and the sum of previously determined vector terms, $$\sum_{i=0}^{k-1} g_i z_i.$$

12 Claims, 4 Drawing Sheets

SCALABILITY TOOL IN MPEG-4 MULTI-PULSES BASED CELP.

SCALABILITY TOOL IN MPEG-4 MULTI-PULSES BASED CELP.

RECURSIVELY EXCITED LINEAR PREDICTION SPEECH CODER

FIELD OF THE INVENTION

The invention relates to digital speech coding, and more particularly to coding the excitation information for code-excited linear predictive speech coders.

BACKGROUND ART

Speech processing systems may first digitally encode an input speech signal before additionally processing the signal. Speech signals actually are non-stationary, but they can be considered as quasi-stationary signals over short periods such as 5 to 30 msec, a period of time generally known as a frame. Typically, the spectral information present in a speech signal during a frame is represented when encoding speech frames. Speech signals also contain an important short-term correlation between nearby samples, which can be removed from a speech signal by the technique of linear prediction. Linear predictive coding (LPC) defines a linear predictive filter representative of this short-term spectral information, which is computed for each frame. A general discussion of this subject matter appears in Chapter 7 of Deller, Proakis & Hansen, Discrete-Time Processing of Speech Signals (Prentice Hall, 1987), which is incorporated herein by reference.

The information not captured by the LPC coefficients is represented by a residual signal that is obtained by passing the original speech signal through the linear predictive filter defined by the LPC coefficients. This residual signal is normally very complex. In early residual excited linear predictive coders, a baseband filter processed the residual signal in order to obtain a series of equally spaced non-zero pulses that could be coded at significantly lower bit rates than the original signal, while preserving high signal quality. Even this processed residual signal can contain a significant amount of redundancy, however, especially during periods of voiced speech. This type of redundancy is due to the regularity of the vibration of the vocal cords and lasts for a significantly longer time span (typically 2.5–20 msec) than the correlation covered by the LPC coefficients (typically<2 msec).

Various other methods, e.g., LPC-10, seek to encode the residual signal as efficiently as possible while still preserving satisfactory quality of the decoded speech. Code-excited linear prediction (CELP) speech encoders are based on one or more codebooks of typical residual signals (or in this context, typical excitation signal code vectors) for the linear predictive filter defined by the LPC coefficients. See for example, Manfred R. Schroeder and Bishnu S. Atal, "Code-Excited Linear Prediction (CELP): High-Quality Speech at Very Low Bit Rates," ICASSP 85, incorporated herein by reference. For each frame of speech, a CELP coder applies each individual excitation signal code vector to the LPC filter to generate a reconstructed speech signal, and compares the original input speech signal to the reconstructed signal to create an error signal. According to this technique, known as analysis-by-synthesis, the resulting error signal is then weighted by passing it through a weighting filter having a response based on human auditory perception. The optimum excitation signal is the code vector that produces the weighted error signal with the minimum energy for the current frame.

In CELP analysis, a pre-emphasized speech signal is filtered by a spectral envelope prediction error filter to produce a prediction error signal. Then, the error signal is filtered by a pitch prediction error filter to produce a residual excitation signal. This target excitation vector x is defined as:

$$x=g_p \cdot y+g_c \cdot z$$

where y is a filtered adaptive codebook vector, $g_p$ its associated gain, z is a fixed codebook vector, and $g_c$ its related gain. As shown in FIG. 1, the codebook may be searched by minimizing the mean-squared error between the weighted input speech and the weighted reconstructed speech. That is:

$$f=x-g_p \cdot y$$

During each subframe, the optimum excitation sequence may be found by searching possible codewords of the codebook, where an optimization criterion is closeness between the synthesized signal and the original signal. Typically, a fixed codebook consists of a set of N pulses (e.g., 2, 3, 4 or 5 pulses) in which each pulse can have a value of +1 or −1. The manner in which pulse positions are determined defines the structure of the codebook vector (ACELP, CS-ACELP, VSELP, HELP, . . . etc.).

One way to reduce the computational complexity of this codebook search is to do the search calculations in a transform domain. Another approach is to structure the codebook so that the code vectors are no longer independent of each other. This way, the filtered version of a code vector can be computed from the filtered version of the previous code vector. This approach uses about the same computational requirements as transform techniques, while significantly reducing the amount of ROM required.

Vector-sum excited linear prediction (VSELP) speech coders, described for example, by U.S. Pat. No. 4,817,157, seek to provide a speech coding technique that addresses both the problems of high computational complexity for codebook searching, and the large memory requirements for storing the code vectors. The VSELP approach—which still belongs to the CELP family of encoders—achieves its goals by efficient utilization of structured codebooks. The structured codebooks reduce computational complexity and increase robustness to channel errors. While in basic CELP encoders only one excitation codebook is used, VSELP introduced using more than one codebook simultaneously. In practice, only two codebooks are used.

In HELP encoders, such as described in U.S. Pat. No. 5,963,897, different kinds of waveforms compete or cooperate to best model the excitation. The waveform can have variable length. Within a frame, the first waveform is always defined with regard to the absolute position of the beginning of the frame. The other waveforms are defined relatively to the first waveform.

SUMMARY OF THE INVENTION

The excitation in a CELP-like speech coder is recursively calculated. For a given bitrate and a given complexity, the recursive approach described lowers the complexity with minimum impact on speech quality. The excitation signal is a sum of at least three vector terms, each vector term being a product of a codebook vector $z_k$ and an associated gain term $g_k$. A first vector term $g_0 z_0$ is determined that is representative of a target excitation vector x. Each remaining vector term is recursively determined as a vector term $g_k z_k$ representative of the difference between the target excitation vector x and the sum of previously determined vector terms, $$\sum_{i=0}^{k-1} g_i z_i.$$

In a further embodiment, the gain term of each vector term $g_k z_k$ is determined by minimizing an error function E representative of the difference between the target excitation vector x and the sum of that vector term and all previously determined vector terms, $$\sum_{i=0}^{k} g_i z_i.$$

The error function E may be the mean squared error of the difference between the target excitation vector and the sum of that vector term and all previously determined vector terms, $$\left[x - \sum_{i=0}^{k} g_i z_i\right]^2.$$

For a given number of vector codebooks M such that M=k, the error E may be derived with respect to each gain $g_1$ to produce a set of (M+1) equations of the form Z.G=X where Z is a correlation matrix of the codebook vectors $z_1$, G is a row vector of the gains $g_i$, X is a correlation vector of the target excitation vector x and the codebook vectors $z_1$, such that all the gain terms in the excitation signal may be jointly quantified from the row vector G.

In another embodiment, each vector term is further the product of a weighting term α. Thus, the first vector term is defined as $\alpha_0 g_0 z_0$, and each recursively determined vector term is defined as $\alpha_k g_0 z_k$, which is representative of the difference between the target excitation vector x and the sum of the previously determined vector terms, $$\sum_{i=0}^{k-1} \alpha_i g_0 z_i.$$

The weighting term α may be defined as a hyperbolic function of index i such that $$\alpha_i = \frac{a}{a+i}.$$

Any of the foregoing methods may be used in a speech coder.

BRIEF DESCRIPTION OF THE DRAWINGS

The present invention will be more readily understood by reference to the following detailed description taken with the accompanying drawings, in which.

DETAILED DESCRIPTION OF SPECIFIC EMBODIMENTS

Figure 1:
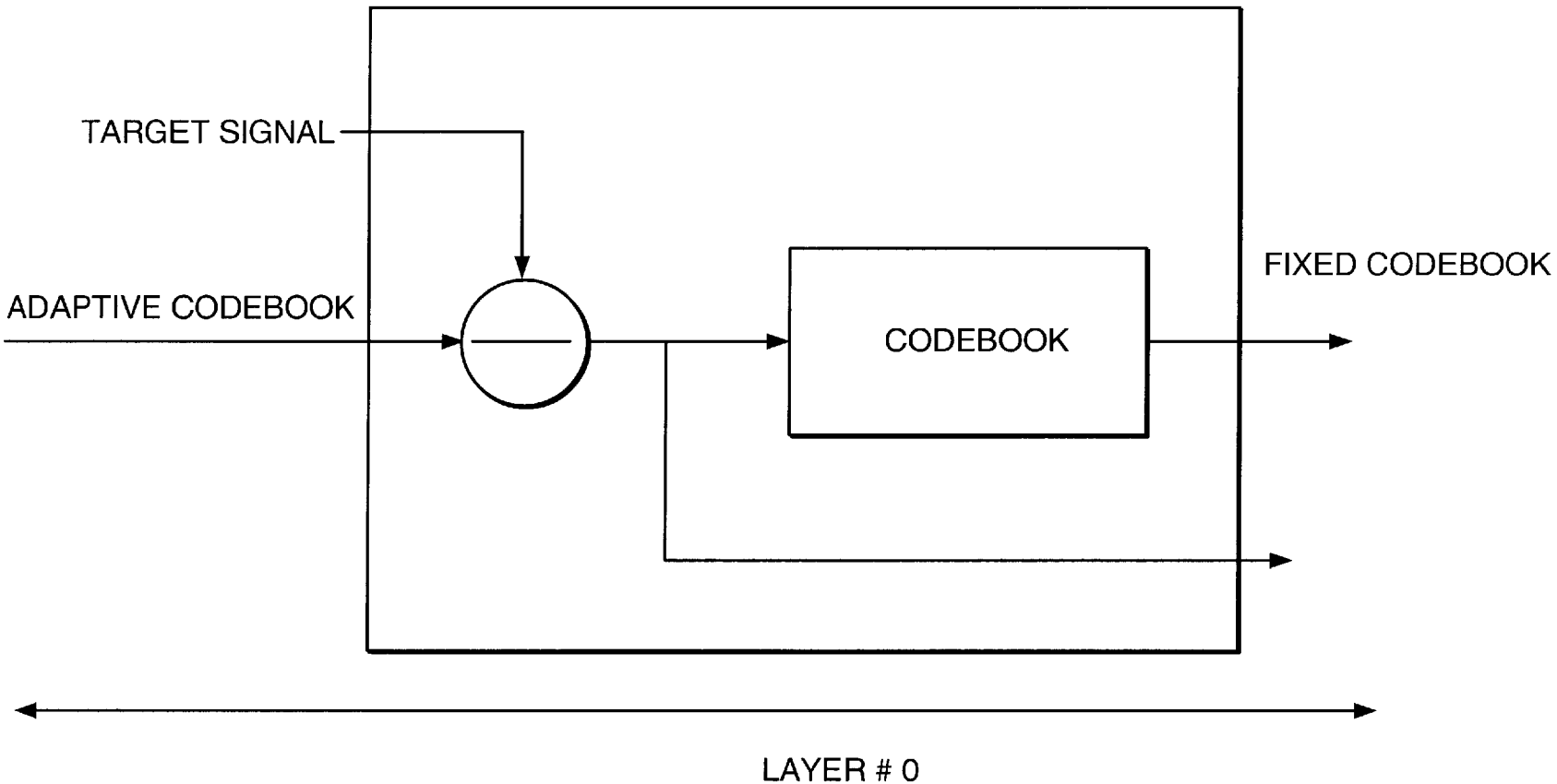
FIG. 1 illustrates the basic operation for calculating a target signal for the next stage in a recursively excited linear prediction coder according to a representative embodiment of the present invention.

In representative embodiments of the present invention, the target excitation signal is defined as a linear combination of M different basic vectors:

$$x = g_0 \cdot z_0 + g_1 \cdot z_1 + g_2 z_2 + \ldots + g_M \cdot z_M$$

The first signal vector may be derived from an adaptive codebook dealing with long-term properties of the speech signal, with the second and subsequent vectors being derived from fixed codebooks. Vector quantization of the associated gains may be associated with this approach scheme so that only pulse signs and positions influence the target bitrate.

Consider the specific example of a system in which an excitation signal is modeled over a subframe of 40 samples at a sampling frequency of 8 kHz. The target bitrate allows the use of 5 excitation pulses, 20 bits per 40 samples, 4000 bps for the codebook. These five excitation pulses may be placed in a single pass (as in ITU G729 standard) using only one codebook, and where a single gain modulates the pulses. The CS-ACELP approach produces $8^5$ (32768) possibilities for the five pulses, but this number is reduced using thresholds that aim to reduce the complexity. Thus, the whole codebook is not searched, and some favorable codewords may be missed.

One representative embodiment of the present invention, for the same target bitrate, uses two codebooks (M=2) with 2 pulses per codebook (2 times 10 bits), with an associated gain for each codebook. Also, the gains may be quantified jointly to avoid an increase in the bitrate due to the gain of the second codebook. Thus, the first pulse can have 8 possible positions, and the second one 32 positions. The total number of codewords is then 8×32=256. Since two codebooks are used, the total number of codewords is then 512, which is very small with respect to the CS-ACELP codebook with 5 pulses. With the foregoing approach, the entire codebook can be searched using less computational resources.

Consider next a system in which the target bitrate allows 40 bits per 40 sample subframe. One standard approach uses 10 pulses where each pulse can have 4 positions (2 bits). This gives a codebook size of $4^{10}$(1048576). Another approach also uses 10 pulses, but organized so that the number of codewords is reduced to 65536 positions. In both cases, the computational complexity is very high, and an effort is made to reduce the number of codewords searched within the codebook.

For the same target bitrate, a representative embodiment of the present invention may use:

- two codebooks (M=2) with 5 pulses per codebook (2 times 20 bits) (65536 codewords), or
- five codebooks (M=5) with 2 pulses per codebook (5×256), or
- three codebooks (M=3) with 3 pulses per codebook (3×2048), or
- any combination which yields a bitrate less than or equal to the target bitrate.

Figure 2:
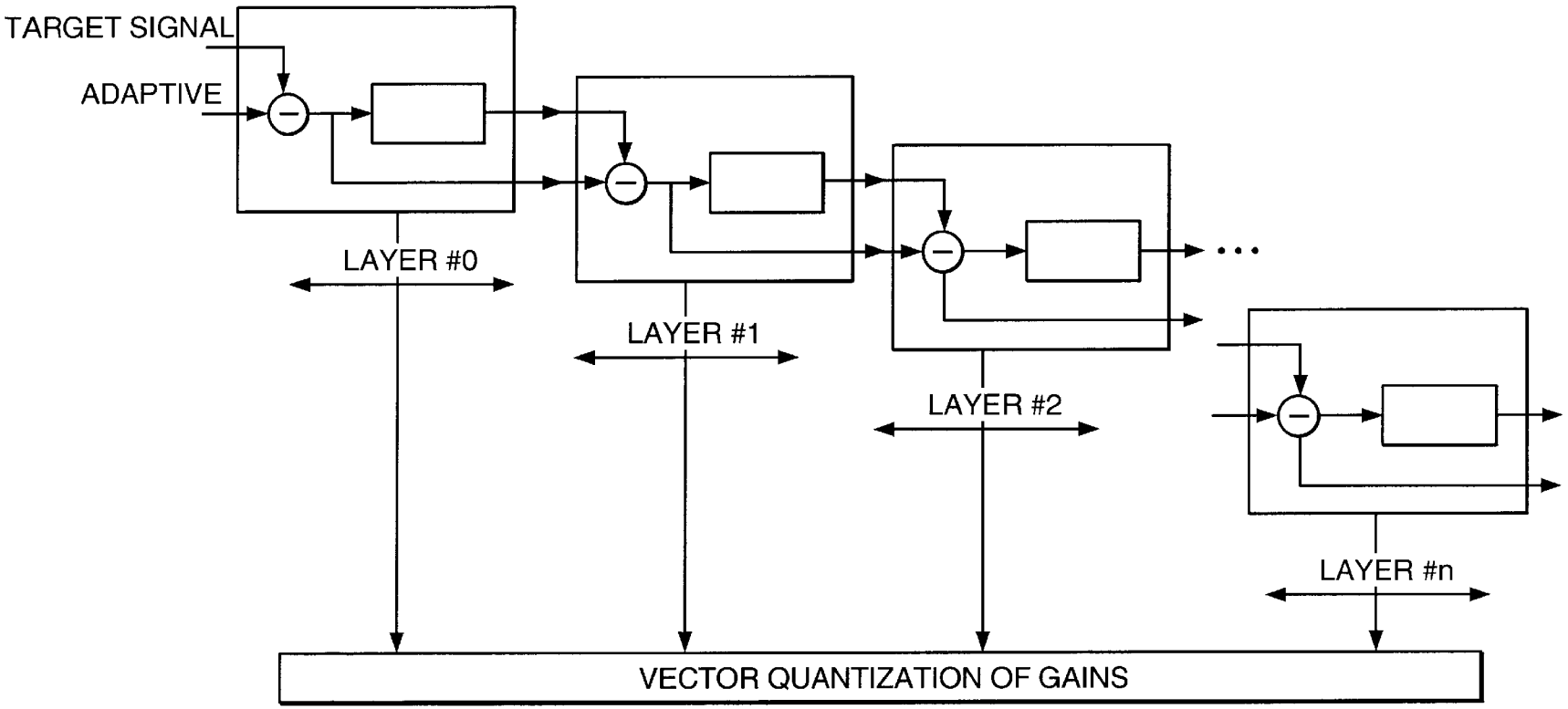
FIG. 2 illustrates recursive calculation of a target vector using multiple basic blocks.

For a more formal description of one specific embodiment shown in FIG. 2, the target excitation x can be described as a linear combination of 3 different basic vectors:

$$x = g_p y + g_{c1} z_1 + g_{c2} z_2 \quad (1)$$

In such an embodiment, the first vector $g_p y$ may be from an adaptive codebook dealing with the long-term properties of the speech signal, while the second and third vectors may be from fixed codebooks. The target excitation vectors can then be defined by the following recurrent relation:

$$x_0=x=g_p y$$

$$x_1=x-x_0=g_{c1}z_1$$

$$x_2=x-x_0-x_1=g_{c2}z_2 \tag{2}$$

The gain codebooks are searched by minimizing the mean-squared weighted error between original and reconstructed speech, which is given for each codebook by:

$$E_p = [x - g_p y]^2 \tag{3}$$

$$E_{cl} = [x_1 - g_{cl} z_1]^2 \tag{4}$$

Deriving $E_p$ and $E_{c1}$ with respect to $g_p$ and to $g_{c1}$, respectively generates the corresponding gains:

$$g_p = \frac{xy^t}{yy^t} \tag{5}$$

$$g_{cl} = \frac{x_1 z_1^t}{z_1 z_1^t} \tag{6}$$

The gain quantification procedure can start by finding the corresponding gains ($g_{pq}$, $g_{c1q}$, and $g_{c2q}$) that minimize the global error $E_{c2}$:

$$E_{c2} = [x - g_{pq}y - g_{c1q}z_1 - g_{c2q}z_2]^2 \tag{7}$$

Thus, the quantified gains may be used to update the memories of the coder.

In a more general description, a target excitation x may be defined as:

$$x = \sum_{i=0}^{M} g_i z_i \tag{8}$$

As shown in FIG. 2, the $k^{th}$ target excitation vector $y_k$ may be described by a recurrent relation:

$$y_k = x - \sum_{i=0}^{k-1} g_i z_i \qquad k = 1 \ldots M \tag{9}$$

Where:

$$y_0=g_0 Z_0 \tag{10}$$

The gain codebooks may be searched by minimizing the mean-squared weighted error between the original speech and the reconstructed speech, which is given for M codebooks by:

$$E = \left[x - \sum_{i=0}^{M} g_i z_i\right]^2 \tag{11}$$

Deriving the error E with respect to each gain $g_1$ produces a set of (M+1) equations:

$$Z \cdot G = X \tag{12}$$

where Z is the correlation matrix of the $z_1$'s vectors, G is the row vector of the gains $g_1$'s and X is correlation vector of the target signal x and the $z_1$'s vectors. The matrix Z is diagonal symmetric and of the form:

$$\begin{pmatrix} z_0 z_0^t & z_0 z_1^t & & z_0 z_M^t \\ z_0 z_1^t & z_1 z_1^t & & z_1 z_M^t \\ & & \ddots & \\ z_0 z_M^t & z_M z_1^t & & z_M z_M^t \end{pmatrix} \tag{13}$$

the vector G is defined by:

$$\begin{pmatrix} g_0 \\ g_1 \\ \vdots \\ g_M \end{pmatrix} \tag{14}$$

and, the correlation vector X is defined by:

$$\begin{pmatrix} x z_0^t \\ x z_1^t \\ \vdots \\ x z_M^t \end{pmatrix} \tag{15}$$

At each step of the recursion, however, only the actual target excitation and the previous contribution of the basic vector signals is present. Thus, the gains may be calculated recursively, considering that in the first step of the recursion, the target signal x is only approximated by $x_0$:

$$x=x_0=g_0 Z_0 \tag{16}$$

The associated gain $g_0$ is then given by:

$$g_0 = \frac{x_0 z_0^t}{z_0 z_0^t} \tag{17}$$

In the second step, the new target signal is then $x_1$, which is given by:

$$x_1=x-x_0=g_1 z_1 \tag{18}$$

Again, the associated gain may be approximated by:

$$g_1 = \frac{x_1 z_1^t}{z_1 z_1^t} \tag{19}$$

And, at the $k^{th}$ step, the gain is given by:

$$g_k = \frac{x_k z_k^t}{z_k z_k^t} \tag{20}$$

The row vector G containing (M+1) gains $g_1$ can then be vector quantified.

If the number of basic vectors used is relatively small (e.g., M<4), then it may be convenient to modify the way the gains are calculated. At the first of the recursion, go may be evaluated using equation (17). Then at the second step, rather than using equation (19) to estimate $g_1$, the system (12) may be solved with M=1 for $g_0$ and $g_1$. The previous value of $g_0$ can be updated with the new calculated one. At the step k+1, solve for M=k, get new values for the k previous value of the gains, and update the necessary memories. Once all M+1 gains have been determined, they may be vector-quantified. Another approach is to calculate the gains for each step of the recursion according to equation (20). When all the gains are estimated, the system (12) can be solved for all the gains, the memories can be updated with these new gains, and the gains can then be quantified.

In a further embodiment, excitation gains may be quantified with a minimum number of bits. This approach assumes that the gains are decreasing if sorted suitably, and subsequent gains are defined relatively to the first calculated gain. This further reduces the bit rate by requiring quantization of only the first gain term $g_0$.

Thus, the target excitation x is defined as:

$$x = \sum_{i=0}^{M} \alpha_i g_0 z_i \tag{21}$$

Where $\alpha_0=1$.

The $k^{th}$ target excitation vector may then be defined by the recurrent relation:

$$y_k = x - \sum_{i=0}^{k-1} \alpha_i g_0 z_i \qquad k = 1 \ldots M \tag{22}$$

Where:

$$y_0 = g_0 z_0 \tag{23}$$

The gain codebooks can be searched by minimizing the mean-squared weighted error between original and reconstructed speech that is given for M codebooks by:

$$E = \left[ x - \sum_{i=0}^{M} \alpha_i g_0 z_i \right]^2 \tag{24}$$

Deriving E with respect to $g_0$:

$$g_0 = \frac{x' \sum_{i=0}^{M} \alpha_i z_i}{\left[ \sum_{i=0}^{M} \alpha_i z_i \right]^2} \tag{25}$$

Figure 4A:
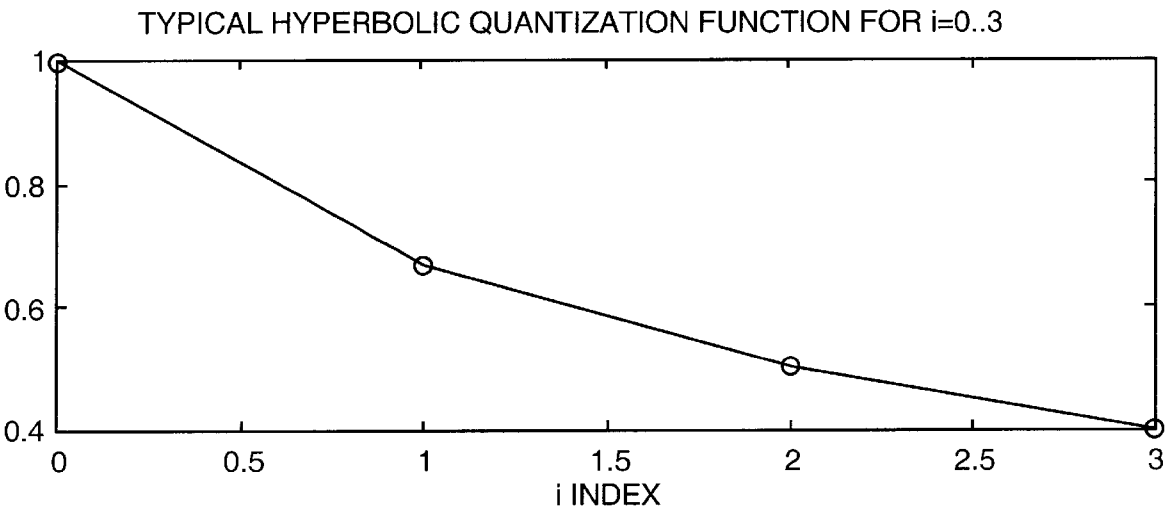
FIG. 4 illustrates typical hyperbolic functions for gain quantification.
Figure 4B:
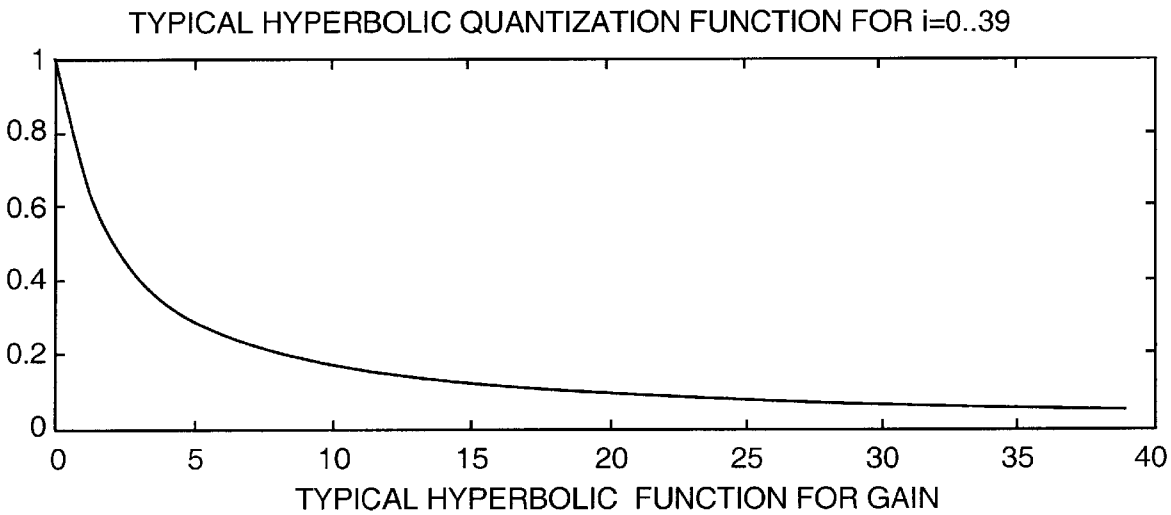

As shown in FIG. 4, the weighting term $\alpha_i$ may be specifically defined as a hyperbolic function of the index i. That is:

$$\alpha_1 = \frac{a}{a+i} \tag{26}$$

Where $\alpha_0=1$, as assumed before. A typical value for $\alpha$ may be 2. Based on this approach, only the gain $g_0$ needs to be quantified and transmitted.

Figure 3:
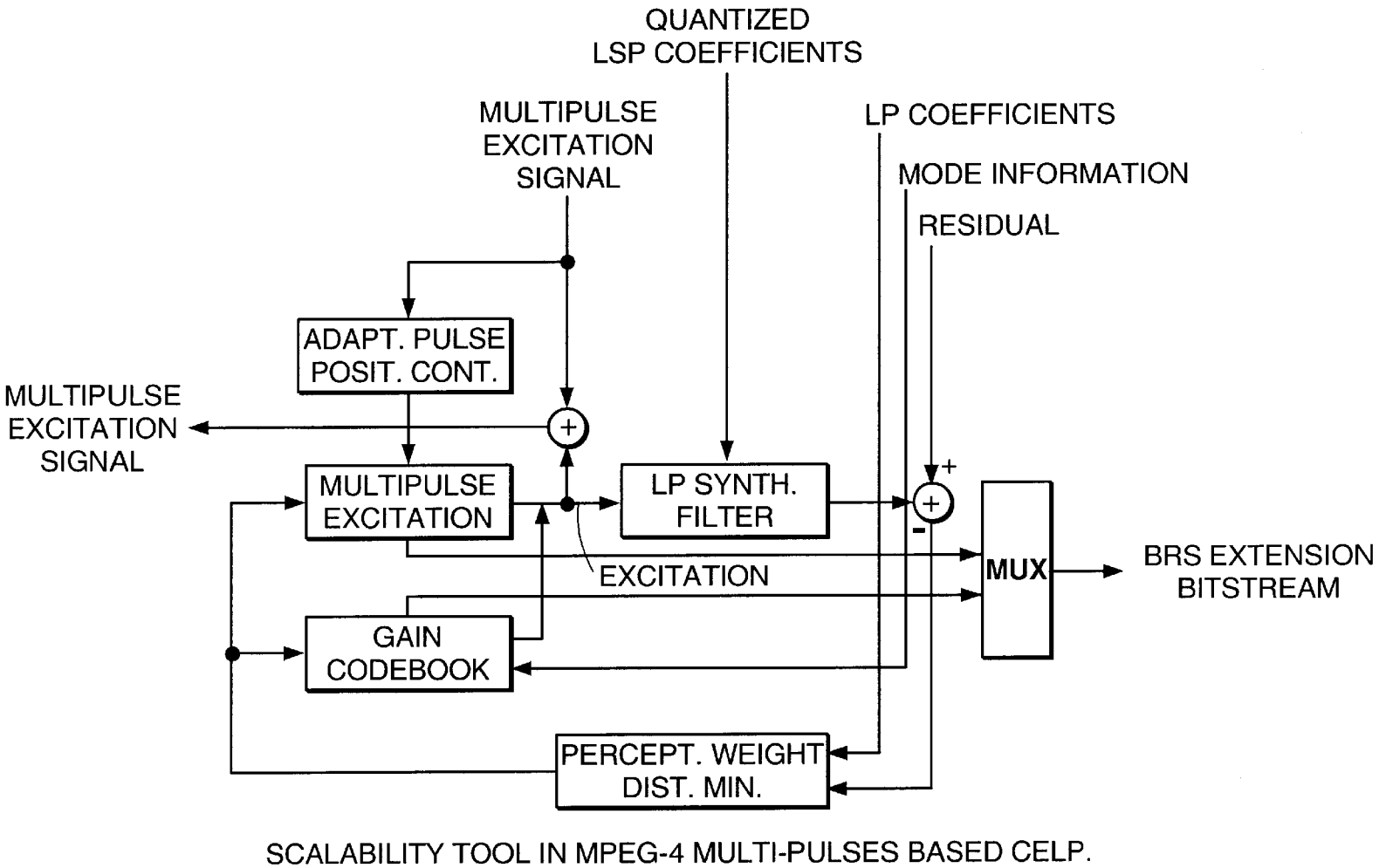
FIG. 3 illustrates the scalability tool in MPEG-4 multi-pulse based CELP.

As described above, representative embodiments of the present invention provide a method for quantifying excitation gains in recursive Recursively Excited Linear Prediction coders. This idea could be applied to any set of ordered values, for example, in a scalable bitrate speech coder. The MPEG-4 coding standard provides a somewhat comparable in its implementation of a scalability tool. See MPEG-4 Final Draft, ISO/IEC 14496-3, July 1999. The MPEG-4 implementation is sketched in FIG. 3, which shows a core encoder and a core decoder that provide a speech coder with a basic bitrate. A Bitrate Scalable Tool (BRS) is used to increase the basic bitrate and to enhance the quality of the synthesized speech. The actual signal to be encoded in the BRS is the residual, which is defined as the difference between the input signal and the output of the LP synthesis filter, supplied from the core encoder.

The MPEG-4 combination of the core encoder and the BRS tool can be considered as multistage encoding of a multi-pulse excitation (MPE). However, in contrast to embodiments of the present invention, there is no feedback path for the residual in the BRS tool connected to the MPE in the core encoder. The excitation signal in the BRS tool has no influence on the adaptive codebook in the core encoder. This guarantees that the adaptive codebook in the core decoder is identical to that in the encoder. The BRS tool adaptively controls the pulse positions so that none of them coincides with a position used in the core encoder. This adaptive pulse position control contributes to more efficient multistage encoding.

Although various exemplary embodiments of the invention have been disclosed, it should be apparent to those skilled in the art that various changes and modifications can be made which will achieve some of the advantages of the invention without departing from the true scope of the invention.

What is claimed is:

1. A method for determining an excitation signal in an analysis-by-synthesis speech coder, the excitation signal being a sum of at least three vector terms, each vector term k being a product of a codebook vector $Z_k$ and an associated gain term $g_k$, the method comprising:

determining a first vector term $g_0 z_0$ representative of a target excitation vector x; and recursively determining each remaining vector term k as a vector term $g_k z_k$ representative of the difference between the target excitation vector x and the sum of previously determined vector terms, $$\sum_{i=0}^{k-1} g_i z_i,$$

and wherein the gain term of each vector term is determined by minimizing an error function E representative of the difference between the target excitation vector x and the sum of that vector term and all previously determined vector terms, $$\sum_{i=0}^{k-1} g_i z_i.$$

2. A method according to claim 1, wherein the error function E is the mean squared error of the difference between the target excitation vector and the sum of that vector term and all previously determined vector terms, $$\left[ x - \sum_{i=0}^{k} g_i z_i \right]^2.$$

3. A method according to claim 2, wherein, for a given number of vector codebooks M such that M=k, the error E is derived with respect to each gain $g_i$ to produce a set of (M+1) equations of the form Z.G=X where Z is a correlation matrix of the codebook vectors $z_i$, G is a row vector of the gains $g_i$, X is a correlation vector of the target excitation vector x and the codebook vectors $z_i$, such that all the gain terms in the excitation signal may be jointly quantified from the row vector G.

4. A method according to claim 1, wherein each vector term is further the product of a weighting term α such that the first vector term is defined as $a_0g_0z_0$, and each recursively determined vector term is defined as $a_kg_0Z_k$, which is representative of the difference between the target excitation vector x and the sum of the previously determined vector terms, $$\sum_{i=0}^{k-1} \alpha_i g_0 z_i.$$

5. A method according to claim 4, wherein the weighting term α is defined as a hyperbolic function.

6. A method according to claim 5, wherein the weighting term αis defined as a hyperbolic function of index i such that $$\alpha_i = \frac{a}{a+i}.$$

7. A computer program for determining an excitation signal in an analysis-by-synthesis speech coder, the excitation signal being a sum of at least three vector terms, each vector term k being a product of a codebook vector $Z_k$ and an associated gain term $g_k$, the program comprising:

a first vector logic for determining a first vector term $g_0z_0$ representative of a target excitation vector x; and a second vector logic for recursively determining each remaining vector term k as a vector term $g_{k,\ zk}$ representative of the difference between the target excitation vector x and the sum of previously determined vector terms, $$\sum_{i=0}^{k-1} g_i z_i,$$

and wherein the gain term of each vector term $g_kZ_k$ is determined by minimizing an error function E representative of the difference between the target excitation vector x and the sum of that vector term and all previously determined vector terms, $$\sum_{i=0}^{k-1} g_i z_i.$$

8. A computer program according to claim 7, wherein the error function E is the mean squared error of the difference between the target excitation vector and the sum of that vector term and all previously determined vector terms, $$\left[x - \sum_{i=0}^{k-1} g_i z_i\right]^2.$$

9. A computer program according to claim 8, wherein, for a given number of vector codebooks M such that M=k, the error E is derived with respect to each gain $g_i$ to produce a set of (M+8) equations of the form Z.G=X where Z is a correlation matrix of the codebook vectors $z_i$, G is a row vector of the gains $g_i$, X is a correlation vector of the target excitation vector x and the codebook vectors z, such that all the gain terms in the excitation signal may be jointly quantified from the row vector G.

10. A computer program according to claim 7, wherein each vector term is further the product of a weighting term a such that the first vector term is defined as $a_0g_0z_0$, and each recursively determined vector term is defined as $a_kg_0z_k$, which is representative of the difference between the target excitation vector x and the sum of the previously determined vector terms, $$\sum_{i=0}^{k-1} \alpha_i g_0 z_i.$$

11. A computer program according to claim 10, wherein the weighting term α is defined as a hyperbolic function.

12. A computer program according to claim 11, wherein the weighting term α is defined as a hyperbolic function of index i such that $$\alpha_i = \frac{a}{a+i}.$$

* * * * *

UNITED STATES PATENT AND TRADEMARK OFFICE

CERTIFICATE OF CORRECTION

PATENT NO. : 6,704,703 B2
DATED : March 9, 2004
INVENTOR(S) : Mohand Ferhaoui et al.

It is certified that error appears in the above-identified patent and that said Letters Patent is hereby corrected as shown below:

Column 8,
Lines 41-45, " $\sum_{i=0}^{k-1} g_i z_i$ " should read -- $\sum_{i=0}^{k} g_i z_i$ --

Column 9,
Line 36, " $g_{k\ zk}$" should read -- $g_k\ z_k$ --

Column 10,
Lines 3-7, " $\sum_{i=0}^{k-1} g_i z_i$ " should read -- $\sum_{i=0}^{k} g_i z_i$ --

Lines 12-16, " $\left[x-\sum_{i=0}^{k-1} g_i z_i\right]^2$ " should read -- $\left[x-\sum_{i=0}^{k} g_i z_i\right]^2$ --

Line 23, "$z$," should read -- $z_i$, --

Signed and Sealed this

Twenty-fourth Day of August, 2004

JON W. DUDAS
*Director of the United States Patent and Trademark Office*